United States Patent [19]

Peterson

[11] 4,350,073

[45] Sep. 21, 1982

[54] HYBRID PIPE ORGAN WITH ELECTRONIC TONAL AUGMENTATION

[76] Inventor: Richard H. Peterson, 11748 Walnut Ridge Dr., Palos Park, Ill. 60464

[21] Appl. No.: 189,984

[22] Filed: Sep. 23, 1980

[51] Int. Cl.[3] ..... G10H 1/02

[52] U.S. Cl. ..... 84/1.25; 84/454; 84/DIG. 18

[58] Field of Search ..... 84/DIG. 4, 1.03, 1.25, 84/DIG. 18, 454, 1.01; 331/46, 47, 51, 55, 56

[56] References Cited

U.S. PATENT DOCUMENTS 3,824,326 7/1974 Obayashi ..... 84/1.25
3,828,109 8/1974 Morez ..... 84/DIG. 4
4,186,637 2/1980 Swan et al. ..... 84/DIG. 4
4,242,935 1/1981 Peterson et al. ..... 84/1.01

*Primary Examiner*—J. V. Truhe
*Assistant Examiner*—Forester W. Isen
*Attorney, Agent, or Firm*—Jones, Tullar & Cooper

[57] ABSTRACT

A hybrid organ is disclosed wherein many of the musical tones comprising the complete musical instrument are produced by wind blown pipes. Other tones are produced by an electronic tone generating system and produced by loudspeakers. The electronic tone generating system is adapted especially for this purpose and includes simplified means for keeping the electronically produced tones in tune with the organ pipes in spite of the fact that the pipes change their pitch with even slight temperature and other atmopsheric changes.

10 Claims, 9 Drawing Figures

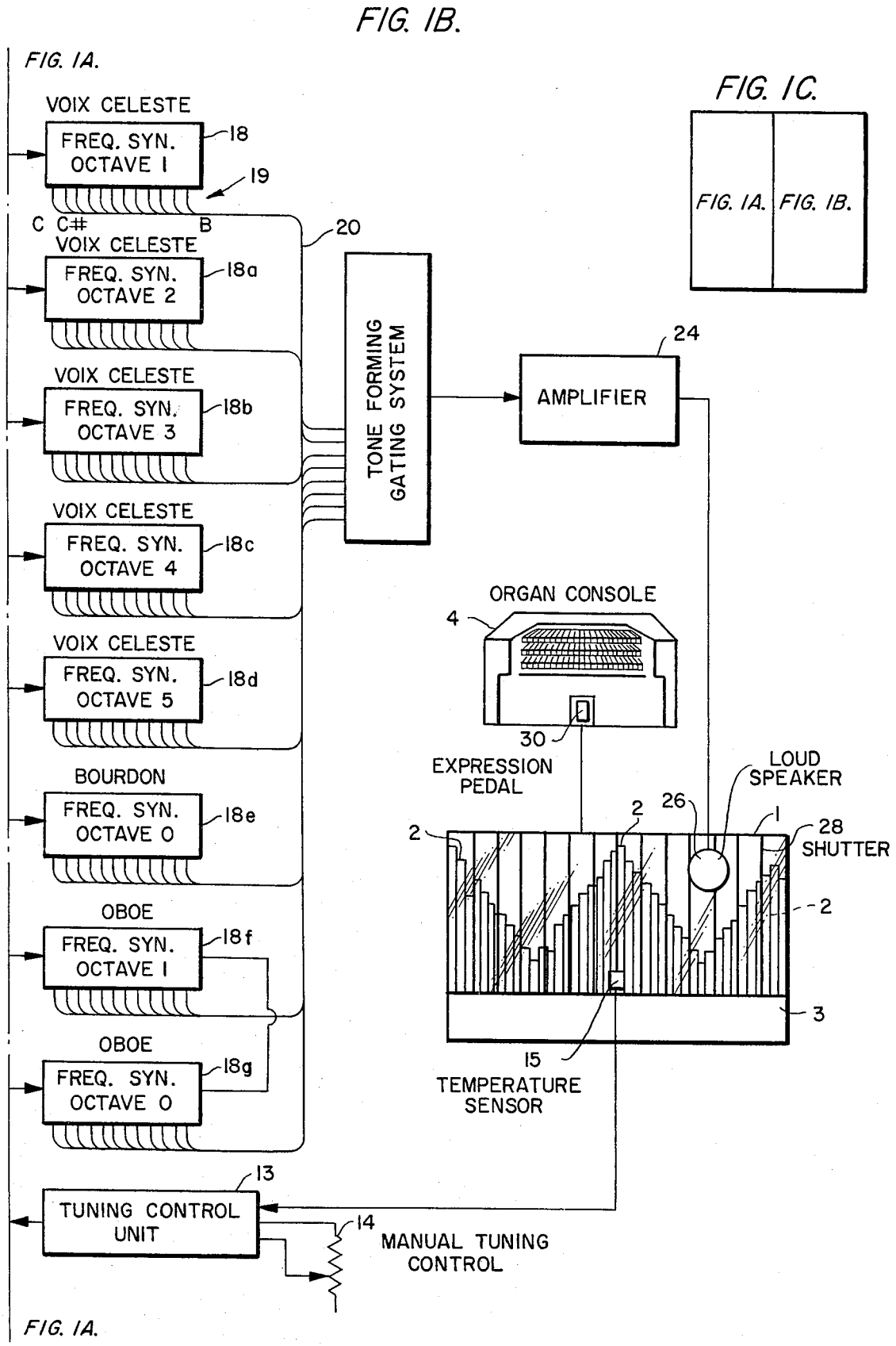
FIG. 1B.
FIG. 1A.
FIG. 1C.
FIG. 1A.
FIG. 1B.
VOIX CELESTE
FREQ. SYN. OCTAVE 1
18
19
C C# B
20
VOIX CELESTE
FREQ. SYN. OCTAVE 2
18a
VOIX CELESTE
FREQ. SYN. OCTAVE 3
18b
VOIX CELESTE
FREQ. SYN. OCTAVE 4
18c
VOIX CELESTE
FREQ. SYN. OCTAVE 5
18d
BOURDON
FREQ. SYN. OCTAVE 0
18e
OBOE
FREQ. SYN. OCTAVE 1
18f
OBOE
FREQ. SYN. OCTAVE 0
18g
TONE FORMING GATING SYSTEM
AMPLIFIER
24
ORGAN CONSOLE
4
30
EXPRESSION PEDAL
LOUD SPEAKER
26
2
1
28
SHUTTER
2
2
3
15
TEMPERATURE SENSOR
13
TUNING CONTROL UNIT
14
MANUAL TUNING CONTROL
FIG. 1A.

FROM TUNING CONTROL UNIT 13 (FIG. 1.)
+ 5 VOLTS
218
216
F.F.
10
219
OUTPUT
215
"OR"
222
FREQ. DIV.
224
IN
220
FREQ. DIV.
214

+15 VOLTS
229
233
228
225
226

HYBRID PIPE ORGAN WITH ELECTRONIC TONAL AUGMENTATION

BACKGROUND OF THE INVENTION

The present invention relates to pipe organs, and more particularly to electrically augmented pipe organs and to means for keeping the pitch of the electronically produced musical tones in tune with the pitch of the tones produced by the organ pipes.

Since the early part of the twentieth century there has been much development in the field of electronic organs, which, for the most part, attempt to imitate the sounds of the pipe organ in which musical tones are produced by wind blown pipes. Much of the charm and character of the sounds from wind blown pipes is the result of the spacial distribution of the pipes, and the sounds they produce, as well as of the very complex nature of the tones themselves. These tones involve dissonant partials at the moment of speech, various types of modulation effects, and many other characteristics yet to be fully understood.

Although the sounds produced by pipe organs are highly desirable, such organs are bulky and expensive, and the larger pipes, which produce the lower pitched tones, require a great deal of wind. Accordingly, organs which utilize the large, bulky lower tones require large air blowers that are often noisy and and must frequently be placed in an out-of-the-way location and connected to the organ wind chests by large wind conductors, thus further increasing the cost and space required. Because of this, attempts have been made to augment pipe organs with electronic tone generation for some of the voices that can be satisfactorily produced by electronic means. Since, in general, the pipes increase in bulk geometrically with descending pitch, it is attractive to produce the tones of the lowest octaves electronically, since in this way much cost can be eliminated and a great deal of space can be saved. Furthermore, since tones in the lowest octaves are normally played monophonically (one note at a time), many of the limitations and compromises that would be involved in using electronic tone generation in the upper and middle octaves are avoided. This is especially true of the number of amplification channels needed to approach the full spacial effects that occur naturally with organ pipes where each and every note speaks from a different point in space.

A problem that must be overcome in a hybrid instrument, where some tones are produced by pipes and some by electronic tone generators, is that of keeping the pitch of the two tone generating systems in tune with one another. In general, electronic tone producers can be made to be quite stable and relatively unaffected by changes in temperature, humidity and atmospheric pressure. Organ pipes, on the contrary, are very much affected by these factors, moving in pitch almost two "cents" (one cent equals one-one hundreth of a semitone) for each degree Fahrenheit of temperature change, and it has been recognized for a long time that in hybrid organs it is necessary to provide means for overcoming this problem. Since there is no known practical way of simultaneously adjusting the tuning of many organ pipes in such a manner that their pitch will "track", it has been easier to vary the pitch of all of the electronically generated notes to bring them into consonance with the pipes at whatever temperature obtains. In my prior U.S. Pat. No. 2,818,759 issued Jan. 7, 1959, there is disclosed an electro-mechanical system designed to move individual pieces of a ferro-magnetic material in the field of each of a large number of individual tone oscillators that generated the electronic tones for a hybrid organ. The system was employed successfully, but was costly and difficult to construct and adjust and had a limited tuning range.

Another system that has been used in commercial hybrid organs involves the insertion of a voltage (or current) into an ordinary oscillator circuit for causing it to detune as the voltage (or current) is varied. These systems are very marginal in performance because each of the many oscillators involved moves to a greater or lesser degree than its neighbors, and thus they do not "track" uniformly. Furthermore, when it is attempted to tune oscillators very far from their nominal frequencies, other problems are usually encountered. For example, the oscillator may not start properly, or its tone or amplitude characteristics may change along with the pitch. In addition such oscillator systems are expensive to construct and adjust.

SUMMARY OF THE INVENTION

The present invention overcomes the problems of prior art hybrid organ systems through the use of a digital tone generation system employing a frequency synthesizer for each separate octave (12 or 13 notes) which is to be electronically produced. Such synthesizers may provide all of the notes for a given stop throughout its range, or may provide only selected notes, such as the lowermost octaves for a given stop to substitute electronically guaranteed tones for the larger organ pipes. A given hybrid organ might use anywhere from one to a hundred or more of these one octave tone generators. Each one-octave tone generator includes a master oscillator operating at a nominal frequency of about 2.5 megaHertz, from which all of the notes of the octave are derived, regardless of what octave of pitches is to be produced. Thus the signals for the low twelve notes of a 16′ pedal Bourdon stop, which would include pitches in the range of approximately 32 Hz to 60 Hz would be derived from a master oscillator of 2.5 mHz nominal pitch. In like manner, the signals for a middle octave of a String Celeste stop lying in the range of 262 Hz–494 Hz would also be derived from another master oscillator also having a nominal pitch of approximately 2.5 mHz. Of course all of the master oscillators, each of which has a nominal frequency of 2.5 mHz, would be tuned to slightly different frequencies, but typically within the range of plus or minus a fraction of one percent, except in the case of Celeste ranks which are purposely detuned a little more, typically in the range of one-half to one and one-half percent (1 to 1-½%).

Each master oscillator is connected either directly, or through one or more frequency dividers, to a corresponding frequency synthesizer for dividing down the input signal to the various musical note frequencies. Frequency synthesizers for accomplishing this objective are widely available in the form of integrated circuits and are well known in the art. Between each frequency synthesizer and its respective master oscillator a frequency changer circuit is provided for subtracting (or adding) an adjustable frequency for the purpose of providing a vernier adjustment for temperature control purposes. The frequency changer circuits are all controlled by a common tuning control unit, which may be a voltage controlled oscillator responsive to temperature variations, may be manually adjustable or both. Each frequency changer varies the output frequency of its corresponding master oscillator in accordance with the single tuning control unit output, so that the oscillator outputs are all varied together. In this way, a variation of the single tuning control unit results in a change in the output frequency of all of the master oscillators and produces corresponding changes in the output frequencies of all of the frequency synthesizers. This allows the synthesizers to be tuned so that the pitch of the electronically generated tones can be tuned to the pitch of the wind-generated tones of the organ pipes. Where manual control of the tuning control unit is provided, the organist can adjust the pitch of the electronic tones as desired. If automatic control is provided, the tuning control unit will maintain the electronic tones in tune with the organ pipe tones, even when the pitch of the organ pipes changes because of humidity, temperature, or other factors. An additional tuning circuit connected to some or all of the master oscillators provides a means for varying the frequencies produced by the frequency synthesizers for purposes of producing vibrato effects.

BRIEF DESCRIPTION OF THE DRAWINGS

The foregoing and additional objects, features and advantages of the present invention will be evident to those of skill in the art from the following more detailed description thereof, taken in conjunction with the accompanying drawings, in which:

FIGS. 1A–1C are a block diagram of a hybrid pipe electronic organ according to the invention;

DESCRIPTION OF PREFERRED EMBODIMENT

Figure 1A:
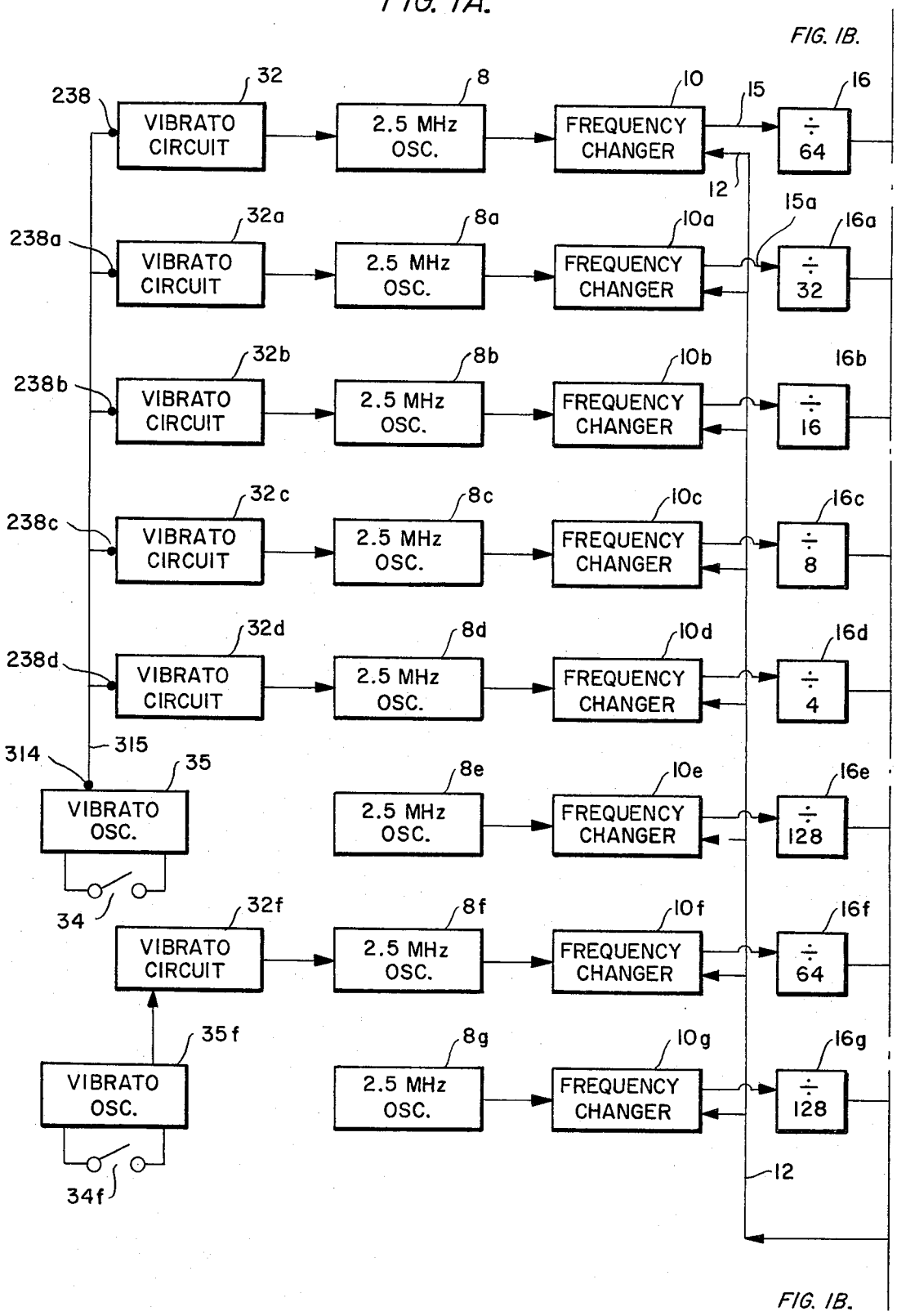

FIG. 1 is a block diagram of a small hybrid organ in which a swell box 1 contains a number of sets (or partial sets) of pipes corresponding to the various stops (tone qualities) to be produced. The individual pipes 2 are positioned on a wind chest 3 which is supplied with air under pressure from a conventinal blower (not shown). Valves under each pipe are controlled from the console through suitable keying and stop control circuits to cause pipes to sound in response to manipulation of the keyboards and stops in the usual manner. Since these parts of the organ are conventional and are well known in the art, it is believed unnecessary to burden this specification with further explanation of their operation.

The remaining blocks shown in FIG. 1 are various elements of an electronic tone generating system for augmenting the basic pipe organ. Two forms of augmention are shown. The first is an electronic tone generating system for producing all of the notes of a stop such as the Voix Celeste stop, and the second is an electronic tone generating system for generating only some of the notes of a stop, such as the lowest two octaves of an oboe stop. The Voix Celeste is a stop including 61 notes (five octaves) of a string-like sound. This stop is not often used by itself, but would typically be used in a combination with a like-toned stop from another electronic system, or from a separate set of pipes, of similar tonal character. The Voix Celeste pipes, however, are tuned so that each note is a little sharp of the corresponding tone in its complimentary rank. The pitch beats produced by the two sets of pipes so tuned produce a very warm musical effect that is highly desirable, but to obtain this effect requires that the tuning between the two sets be capable of adjustment to a high degree of nicety, and that once adjusted the relative tuning remain constant. The use of electrical tone generating systems wherein octavely related tones are produced by ordinary frequency division are totally unsatisfactory for such a purpose, however, because the pitches of the notes of the individual octaves cannot be separately adjusted. The present invention solves this problem by providing separate, adjustable, one-octave tone generators for each octave of notes required.

Referring again to FIG. 1, a first master oscillator 8 having a normal frequency of 2.5 mHz provides the input signal for a first octave. The output of this oscillator is connection to a frequency changer circuit 10 which is capable of varying the 2.5 mHz output frequency of oscillator 8 by an amount up to about 10% in response to a control signal applied to line 12. This control signal is produced by a tuning control unit 13, and the nature of the control signal is varied manually by the manual tuning control 14 and/or automatically by the temperature sensor 15 located so as to sense the temperature in the vicinity of pipes 2. If desired, humidity, atmospheric pressure and other parameters can also be sensed and such information used to control the tuning control unit 13.

The control signal on line 12 causes the frequency changer circuit 10 to modify the 2.5 mHz input signal and to produce at its output to line 15 a new adjusted frequency which is connected to a frequency divider 16, the output of which is connected to a frequency synthesizer 18. In a preferred embodiment, the frequency changer is a pulse dropper circuit which reduces the output frequency from the master oscillator to about 2.39 mHz, which when divided by the dividers 16, supplies whatever frequencies are needed to the synthesizers to produce notes in the desired octave range. The 2.39 mHz output is provided at a room temperature of 70° F. By using the frequency changer to reduce the nominal output frequency from the oscillator in normal room temperature conditions, the system is capable of both increasing and decreasing the frequency supplied to the synthesizer as room temperature, humidity and like factors vary either upwardly or downwardly.

Frequency synthesizers are well known in the art, and are customarily manufactured in the form of integrated circuits that produce at twelve or thirteen output terminals, a series of notes of a musical scale. The terminals are generally indicated at 19 in FIG. 1, and produce the notes C, C♯, D, D♯, E,F, F♯, G, G♯, A, A♯, B and C. The frequency synthesizer is more fully described in connection with FIG. 3, hereinbelow.

The octave in which the notes are produced is determined by the dividing ratio of the frequency divider 16. If no frequency divider is used, the tones would appear in the 7th octave, and the output signals would be between 4186 Hz and 7902 Hz. Using a two to one dividing ratio lowers the output signals by one octave, a four to one dividing ratio lowers the output by two octaves, and so on.

All of the note signals at the output terminals 19 of the frequency synthesizer 18 appear at these terminals at all times while the instrument is turned on, and to be useful for producing musical tones they must be "keyed" or "gated", and tonally modified to produce whatever musical tones are required to augment the sound of the organ pipes. Since such keying and the necessary tone forming circuitry are so well known in the electronic organ art, the wiring and details of these subsystems are not shown except in FIG. 1 where the frequency synthesizers are shown connected by way of cables 20 to the tone forming and gating system 22 and thence to the amplifier 24 and loudspeaker 26 located in the swell box 1. Placing the loudspeaker or speakers in the swell box permits the electronic sounds to have the same "expression" as the pipes produced, for example, by means of movable shutters 28 which are arranged to be opened and closed as determined by the position of an expression pedal 30 controlled by the organist's foot. A suitable swell box is illustrated in greater detail in my copending patent application, Ser. No. 177,546 filed Aug. 5, 1980.

Associated with the 2.5 mHz oscillator 8 is the vibrato circuit 32, which varies the frequency of the oscillator slightly above and below its normal frequency for purposes of creating a vibrato (sometimes called a "tremolo") effect. Closing switch 34 starts a vibrato oscillator 35 which causes the vibrato circuits to introduce the vibrato effect.

The circuits so far described cover the operation of the lowest octave of the Voix Celeste stop, which actually includes five octaves. The remaining octaves are generated by similar circuitry with the same reference characters except for the addition of the subscript a for the second octave circuitry, b for the third octve, c for the fourth octave, and d for the fifth octave. The blocks 8*e*, 10*e*, 16*e*, and 18*e* in like manner produce 12 tones that are used for the lowest 12 notes (the 16 foot octave) of the Bourdon stop, it being understood that the rest of the notes of this stop are produced by pipes. No vibrato circuit is used with this stop because such low notes sound better without vibrato. In like manner, blocks 32*f*, 34*f*, 8*f*, 10*f*, 16*f* and 18*f* comprise the tone generating system for the 8 foot, or "1", octave of an oboe stop, and block 8*g*, 10*g*, 16*g*, and 18*g* comprise the tone generating system for the 16 foot to "0" octave of the oboe stop.

An important advantage of the tone generating system described is that each single octave of notes can readily be built in the form of very small circuit board assembly, and that the electronic tone generating equipment for a hybrid pipe organ of any size and specification can be constructed by using as many identical circuit board assemblies as there are octaves of notes required. The tuning method of the invention permits the frequency changers (or fine tuners) of all of the electronically generated notes to be adjusted simultaneously by either the manual control 14 or the automatic control 13, and to "track" perfectly to keep the organ in tune at any temperature, yet the individual one-octave tone generator boards do not require any selected or adjustable parts. It is this simplicity of construction, and the assurance of perfect harmony between the pipe tones and the electronically generated tones that make possible a satisfactory and economical hybrid pipe organ.

Figure 2:
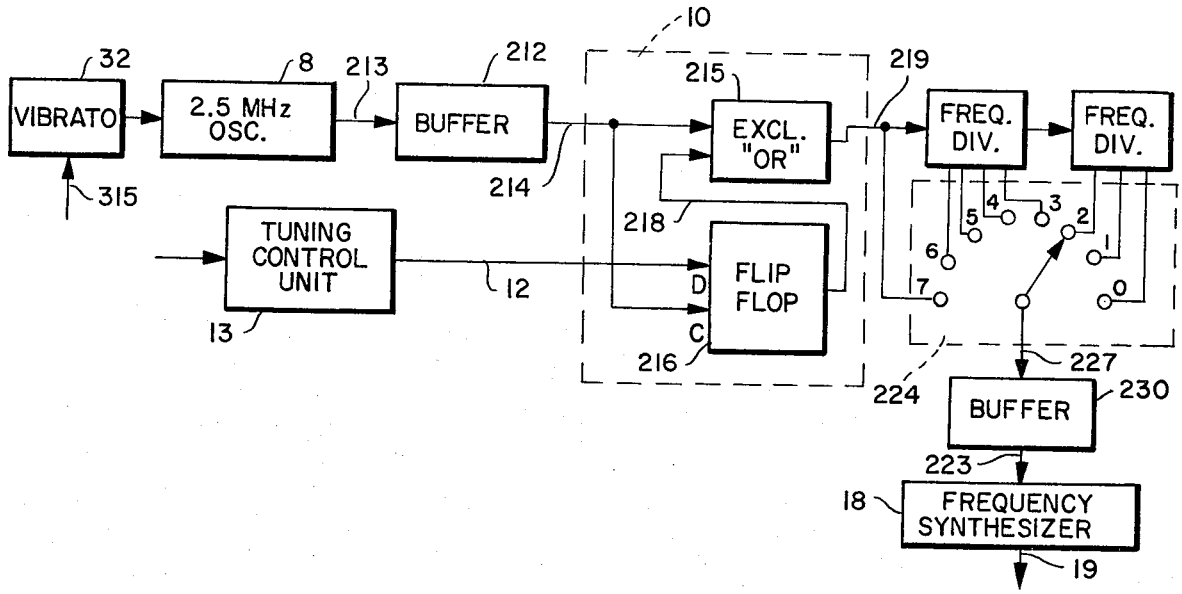
FIG. 2 is a more detailed block diagram of a single octave tone generator according to the invention.
Figure 3A:
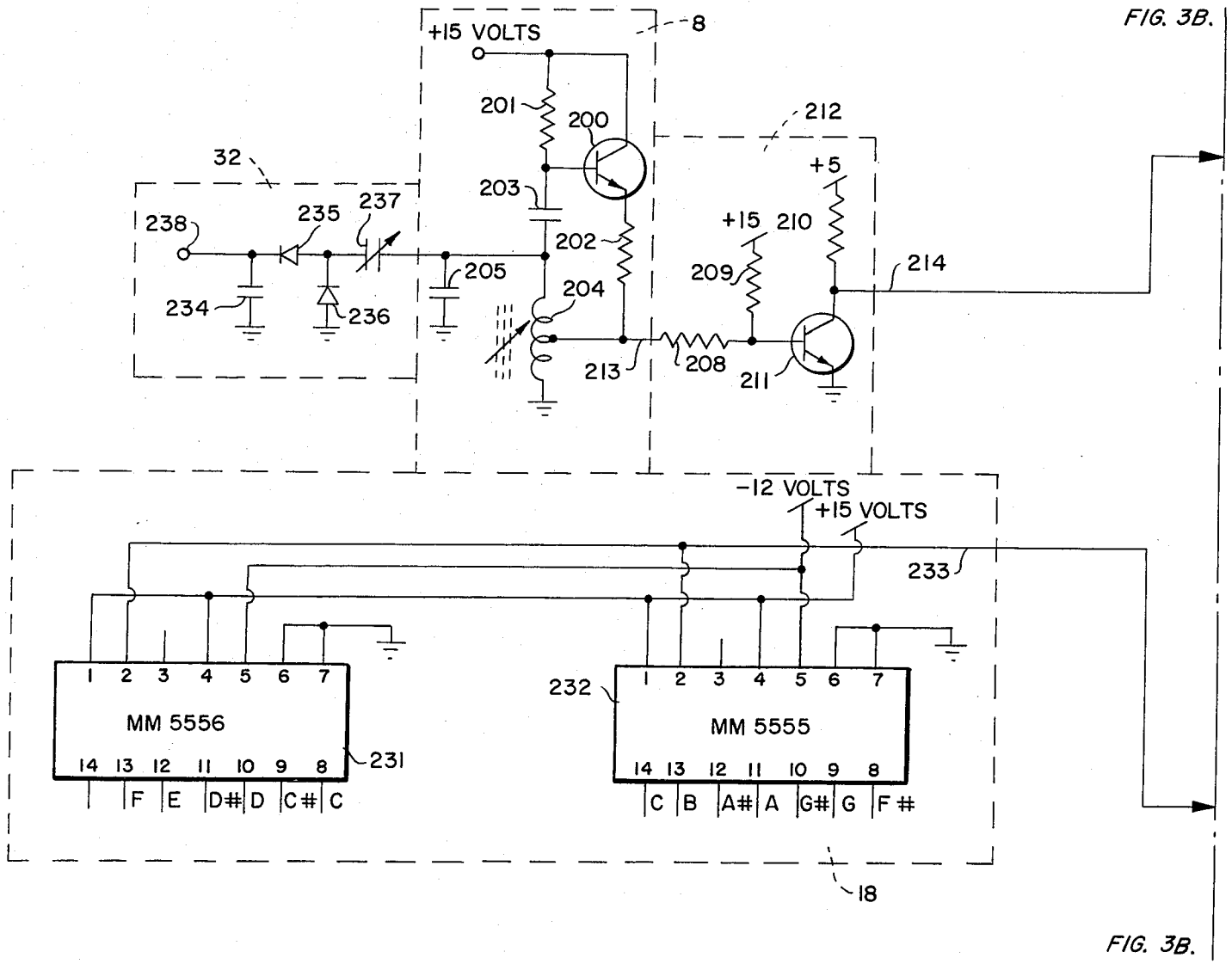
FIGS. 3A–3C are a schematic circuit diagram of the single octave tone generator of FIG. 2.
Figures 3A, 3B, 3C:
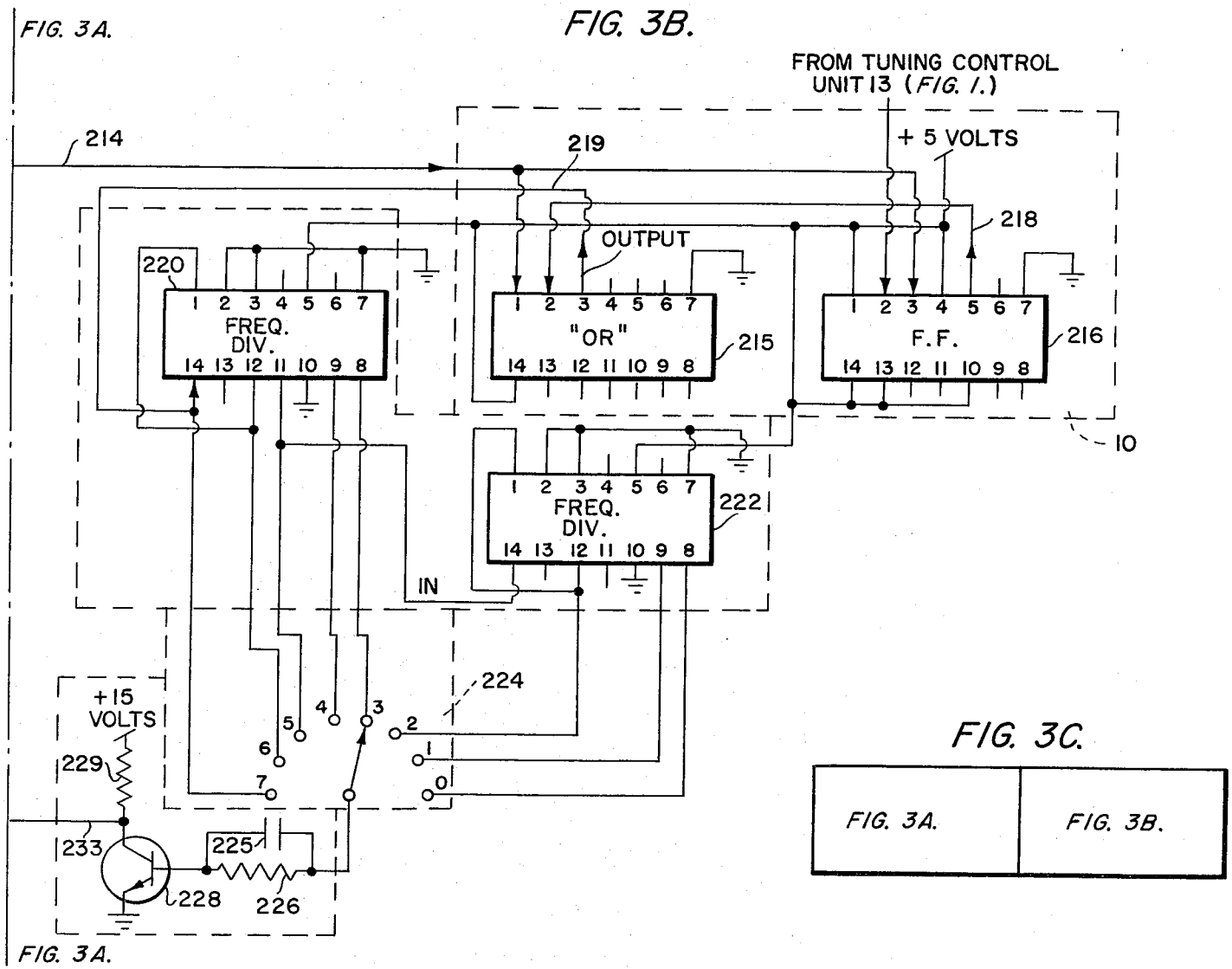

A more detailed version of the circuitry employed in a preferred embodiment of a single octave will now be described in connection with FIGS. 2 and 3, FIG. 2 being in block diagram form and FIG. 3 being a schematic diagram. Transistor 200, resistors 201 and 202, capacitor 203, adjustable inductor 204 and tuning capacitor 205 comprise a conventional oscillator 8 capable of being tuned to the desired frequency of approximately 2.5 mHz. Resistors 208, 209 and 210 and transistor 211 comprise a buffer circuit 212 connected between the output line 213 of oscillator 8 and input line 214 of frequency changer 10, the buffer output being connected to input #1 of an integrated circuit exclusive "or" gate 215 (FIG. 3). This may be a National Semiconductor Corporation Type 7486 or equivalent. The output line 214 of the buffer is also connected as a clocking signal to pin 3 of integrated circuit "D" flip flop which is one of two such flip flops packaged together in the integrated circuit 216, which may the the type 7474 as manufactured by the National Semiconductor Corporation. The data input terminal of this flip flop (pin 2) is connected to the output of the tuning control unit 113 by way of line 12 (see FIGS. 1 and 2). The output of the tuning control unit 13 is a rectangular wave having a frequency which is variable in accordance with the manual tuning control 14 and/or the temperature sensor 15 (shown in FIG. 1), as described above.

The Q output of the "D" flip flop 216 appears at pin 5 of the integrated circuit and is connected by way of line 218 to input pin 2 of the exclusive "or" gate 215. Integrated circuits 215 and 216 operate as a frequency changer to effectively subtract the frequency produced by the tuning control unit from the frequency of the 2.5 mHz oscillator 8.

The output of the frequency changer 10 that appears at pin 3 of the "or" gate 215 is connected by way of line 219 to the input (pin 214) of a four stage binary frequency divider in the form of an integrated circuit 220, which may be a National Semiconductor type 7493. A second chip 222 of the same type is used as an additional three stage binary divider. These seven divider stages are cascaded and the output signals from the successive dividers are brought out to the terminals 0–6, of the switch 224, with the output from the frequency changer being applied directly to terminal 7 of the switch. The position of the switch determines which of eight octavely related signals is applied to the frequency synthesizer and thus determines the octave in which the final notes are to appear. In actual construction the switch would preferrably be replaced by a "jumper field" in which a jumper wire can be inserted in the proper location to produce the equivalent of a switch, but at lower cost.

Capacitor 225 and resistor 226 sharpen the rise and fall times of the signal appearing on line 227 from the frequency driver selected by switch 224, and the signal is connected to the buffer transistor 228 having a collector load 229 (FIG. 3) in buffer 230. Two integrated circuits 231 and 232 whic may be National Semiconductor types. MM5555 and MM5556, respectively, comprise the frequency synthesizer 18. The buffered signal from the collection of transistor 228 is connected to each of the frequency synthesizer "chips" 231 and 232 at pin 2 thereof by way of line 233.

As indicated above, the frequency synthesizer 18 requires an input signal of 2.39 mHz to produce a musical scale based on A equals 7040 hz in the top (7th) octave. This translates to A=440 Hz in the third octave, which is the internationally recognized "standard pitch" for musical instruments. The integrated circuits 231 and 232 produce at their output terminals 19 (pins 8–13) and 8–14, respectively) a series of audio signals corresponding to notes of the muscial scale as shown in FIG. 3. The note "C" appears twice, one being the bottom "C" of the octave, and the other being the top "C". Usually only 12 notes per octave are required, but the 13th note is often useful either for the highest mote of the keyboard, or to permit the wiring of the system as taught in the copending application of Richrd H. Peterson and Robert Finch, Ser. No. 827,655, filed 8–25–77, now U.S. Pat. No. 4,242,935 to obtain the musical advantages described in that disclosure.

Capacitors 234 and 237, and diodes 235 and 236 comprise a vibrato circuit for applying a frequency modulation to the 2.5 mH oscillator 8. Its operation is as follows. Inductor 204 and capacitor 205 comprise a tank circuit that is the primary determinant of the frequency of oscillation of the 2.5 mHz oscillator 8, and an AC voltage appears across this tank circuit during oscillation of the circuit. Capacitor 237 is an ancillary tuning capacitor that can be made variably effective to tune the oscillator depending on the biasing of the diodes 235 and 236. The bias on the diodes is in turn varied by the low frequency vibrato oscillator 35 whose signal is connected to vibrato terminal 238. Capacitor 237 is adjustable to permit each octave of notes to have the depth of its vibrato set as desired.

Figure 4:
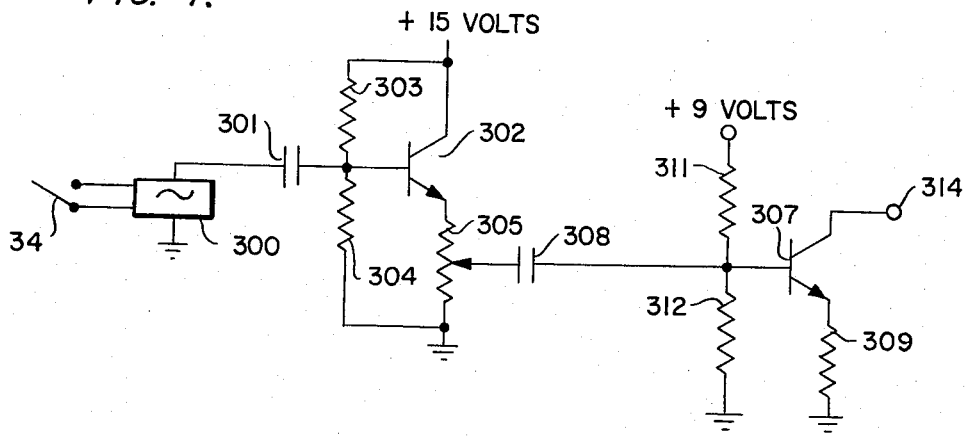
FIG. 4 is a schematic circuit diagram of a vibrato oscillator suitable for use with the system of FIG. 1.

FIG. 4 is a diagram of the circuitry of vibrato oscillator 35. A sine wave oscillator 300 having a frequency in the vibrato range of about 5 to 8 Hz is provided. It may be any conventional oscillator such as a Hartley oscillator, phase shift oscillator or an integrated circuit function generator. Closing switch 34 starts the oscillator, the output of which is connected through coupling capacitor 301 to an emitter follower comprised of transistor 302 and resistors 307 through capacitor 308. Resistor 309 provides negative feedback and stabilizes the input impedance of the transistor 307. Resistors 311 and 312 bias the transistor 307 into a state of partial conductivity, and when the oscillator 300 is tuned on it varies the conductivity above and below this quiescent point. The output terminal 314 is connected by way of line 315 to the terminals 238 of FIG. 3. In FIG. 1 the vibrato oscillator **35*f*** is identical to that described and supplies the vibrato signal for the 8′ octave of the Oboe stop, as described above.

Figure 5:
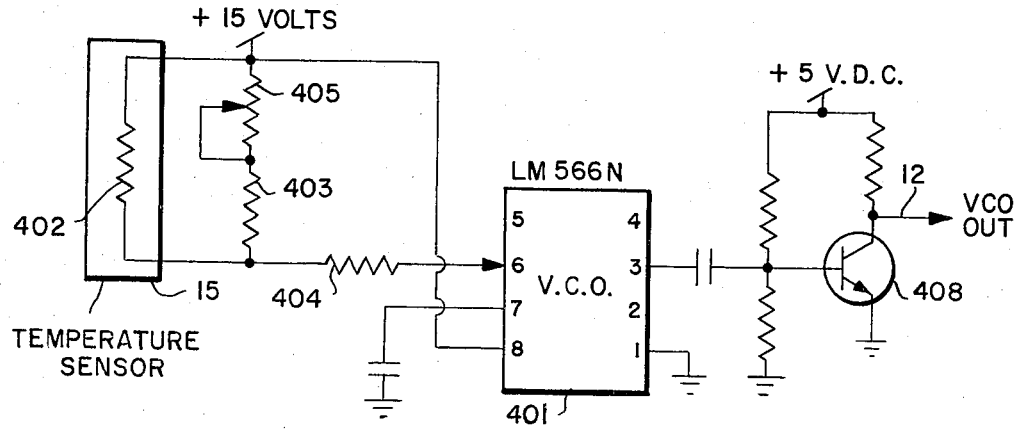
FIG. 5 is a schematic circuit diagram of a temperature sensor and tuning control circuit for use with the system of FIG. 1.

FIG. 5 is a schematic diagram of the tuning control unit 13 and the temperature sensor 15. In this circuit an integrated circuit 401, which may be a type LM 566N made by National Semiconductor Corporation, is used as a voltage controlled oscillator, or generator. The frequency of the pulses produced is determined by the current injected into pin 6 of the integrated circuit 401, and it is this frequency which determines the extent to which the frequency changers **10–10*g* (in FIG. 1) change the frequency of the 2.5 mHz oscillators, and thus the tuning of all of the electronically generated "octaves". Resistors 402, 403, 404, and manually adjustable resistor 405 form a network the parameters of which determine the current supplied to terminal 6 of circuit 401. Ordinarily, the adjustable resistor 405 would be controlled by a knob at the organ console 4 (FIG. 1) to provide a vernier pitch control, while one or more of the resistors 402, 403 and 404 would be resistors having controlled temperature versus resistance characteristics, and would be placed in the environment of the organ pipes as shown in FIG. 1 at 15**. Thus, changes in the temperature of the environment surrounding the pipes will influence the frequency of the pulses produced in such a manner as to keep the electronic tones in consonance with the pipe tones. The manual vernier adjustment is not absolutely necessary, but can be used to correct any slight errors permitted by the electronic sensor system. Under some conditions, such as in a well air-conditioned building, having only a manually-operated vernier tuning control might be sufficient, and the temperature sensing system might be dispensed with, but such is not the usual case.

The output of circuit 401 appears at pin 3, is buffered and level translated by the transistor switch 408 and is connected to all of the frequency changers 10 by way of line 12 (FIG. 1).

Although the present invention has been described in terms of a preferred embodiment, it will be apparent that variations and modifications can be made without departing from the true spirit and scope of the invention as defined in the following claims. It should be understood, for example, that the preciseness of the "tracking" of the output signals from the various pitch changers 10, **10*a*, 10*b*, etc. is a function of how nearly identical are the frequencies of the various 2.5 mHz oscillators, 8, 8*a*, 8*b* and so on. These oscillators all have the same nominal frequency of 2.5 mHz, but are actually detuned slightly from nominal as required to produce the desired chorus effects between the electronically produced voices. Experience has shown that adequate tracking for a hybrid organ of the type described can be obtained so long as the variation from one to another of the 2.5 mHz oscillators does not exceed about eight percent (8%). Accordingly, in the context of this application, the word nominal should be understood to permit variations of up to about this extent. Although only one amplifier and loudspeaker are shown, an actual instrument would ordinarily have additional amplification channels for the different voices. Further, it will be understood that the several octaves illustrated in FIG. 1 are exemplary only, and that any desired number of octaves, each having its own oscillator and frequency changing circuit as shown in FIGS. 2 and 3**, may be provided.

What is claimed is:

1. A tuning circuit for a hybrid organ having both wind and electronically generated tones, comprising:

a plurality of frequency synthesizers, each synthesizer producing a corresponding one of a plurality of octaves of electronically generated tones;

a master oscillator for each frequency synthesizer, all of said oscillators having the same nominal frequency of oscillation;

a frequency changer for each master oscillator, each frequency changer being capable fo varying the frequency of the output from its corresponding master oscillator;

means connecting the frequency-varied output of each said master oscillator to its corresponding frequency synthesizer; and tuning control means connected in common to all of said frequency changers for simultaneously varying all of said frequency changers, whereby the outputs of all of said master oscillators can be simultaneously varied from their nominal frequencies to vary the pitches of the electronically generated tones produced by said frequency synthesizers.

2. The tuning circuit of claim 1, further including manual means for adjusting said tuning control means.

3. The tuning circuit of claim 1, further including sensor means responsive to selected parameters for automatically adjusting said tuning control means.

4. The tuning circuit of claim 3, further including manual means for adjusting said tuning control means.

5. The tuning circuit of claim 1, wherein said means connecting the output of each master oscillator to its corresponding frequency synthesizer comprises a frequency divider for each master oscillator output.

6. The tuning circuit of claim 1, further including vibrato circuit means for periodically varying the frequency of a master oscillator.

7. The tuning circuit of claim 1, wherein said tuning control means is a voltage controlled oscillator having a variable output frequency.

8. The tuning circuit of claim 7, wherein each said frequency changer comprises circuit means for subtracting the output of said tuning control means from the output of the corresponding master oscillator.

9. The tuning circuit of claim 8, further including sensor means for automatically varying the output frequency of said tuning control means for maintaining the electronically generated tones in pitch with wind generated tones produced by an hybrid organ.

10. The tuning circuit of claim 8, further including manual means for varying the output frequency of said tuning control means to adjust the pitch of the electronically generated tones with respect to the pitch of wind generated tones of an hybrid organ.

* * * * *